US007708218B2

(12) United States Patent
Nakayama et al.

(10) Patent No.: US 7,708,218 B2
(45) Date of Patent: May 4, 2010

(54) JAW CRUSHER AND SELF-TRAVELING CRUSHER

(75) Inventors: Tooru Nakayama, Hirakata (JP); Ryoichi Togashi, Hirakata (JP); Kentaro Ito, Hirakata (JP); Kouzo Suzuki, Hirakata (JP)

(73) Assignee: Komatsu Ltd., Tokyo (JP)

( * ) Notice: Subject to any disclaimer, the term of this patent is extended or adjusted under 35 U.S.C. 154(b) by 80 days.

(21) Appl. No.: 11/991,192

(22) PCT Filed: Aug. 24, 2006

(86) PCT No.: PCT/JP2006/316552

§ 371 (c)(1),
(2), (4) Date: Feb. 28, 2008

(87) PCT Pub. No.: WO2007/026590

PCT Pub. Date: Mar. 8, 2007

(65) Prior Publication Data

US 2009/0152387 A1 Jun. 18, 2009

(30) Foreign Application Priority Data

Aug. 29, 2005 (JP) ..... 2005-248006

(51) Int. Cl.
*B02C 1/02* (2006.01)

(52) U.S. Cl. ..... 241/101.74; 241/267

(58) Field of Classification Search ..... 241/264–269, 241/101.74

See application file for complete search history.

(56) References Cited

U.S. PATENT DOCUMENTS 7,124,971 B2 10/2006 Sugimura et al.
7,168,644 B2 1/2007 Togashi et al.
2003/0034412 A1 2/2003 Togashi et al.
2004/0124295 A1 7/2004 Sugimura et al.
2004/0129815 A1 7/2004 Togashi et al.

(Continued)

FOREIGN PATENT DOCUMENTS

EP 1 424 132 A1 6/2004

(Continued)

OTHER PUBLICATIONS

Finnish Office Action dated Feb. 26, 2009 (4 pages), and English translation thereof (4 pages), issued in counterpart Finnish Patent Application No. 20085245.

(Continued)

*Primary Examiner*—Mark Rosenbaum
(74) *Attorney, Agent, or Firm*—Frishauf, Holtz, Goodman & Chick, P.C.

(57) ABSTRACT

A jaw crusher includes: a crusher frame to which a cross member for connecting a pair of side wall plates is provided; a fixed jaw; a swing jaw swingably hung between the side wall plates; a pair of toggle link pins both of which are disposed along a common axial direction having a first outer end pivoted on the side plate and a second inner end pivoted on a main supporter provided to the cross member; and a reaction force-receiving link mechanism including a toggle link rotatably supported by the toggle link pin. The main supporter of the cross member on which the second end of the toggle link pin is pivoted is box-shaped.

8 Claims, 10 Drawing Sheets

U.S. PATENT DOCUMENTS

| | | | |
|---|---|---|---|
| 2009/0095833 | A1 | 4/2009 | Nakayama et al. |

FOREIGN PATENT DOCUMENTS

| | | | |
|---|---|---|---|
| JP | 05-004824 | Y1 | 4/1930 |
| JP | 6-91182 | A | 4/1994 |
| JP | 7-9436 | U | 2/1995 |
| JP | 2004-174450 | A | 6/2004 |
| JP | 2004-174452 | A | 6/2004 |
| KR | 20-0306703 | Y | 3/2003 |

OTHER PUBLICATIONS

International Preliminary Report on Patentability, Chapter I of the Patent Cooperation Treaty, and Written Opinion dated Sep. 9, 2008 for PCT/JP 2006/316552, 4 sheets.

JAW CRUSHER AND SELF-TRAVELING CRUSHER

This application is a U.S. National Phase Application under 35 USC 371 of International Application PCT/JP2006/316552 filed Aug. 24, 2006.

TECHNICAL FIELD

The present invention relates to a jaw crusher and a self-propelled crushing machine having the jaw crusher.

BACKGROUND ART

Conventionally, a jaw crusher that crushes raw materials by swinging a swing jaw with respect to a fixed jaw is known. The fixed jaw and the swing jaw are supported by a crusher frame. Raw materials are thrown into a region surrounded by the fixed jaw, the swing jaw and the crusher frame, and then the swing jaw swings to crush the raw materials between the fixed jaw and the swing jaw.

Such a jaw crusher is arranged to receive reaction force from crushing of raw materials with a reaction force-receiving link mechanism. The reaction force-receiving mechanism substantially includes, for example, a link plate whose first end is engaged to a rear surface of the swing jaw, a toggle link that supports a second end of the link plate and rotates about a fixed link pin, and a lock cylinder whose lower end is connected to the toggle link (e.g., see Patent Document 1).

In the reaction force-receiving link mechanism, a rotational axis of the toggle link is a dual type toggle link pin, a pair of which are serially disposed along the width direction of the jaw crusher. An outer (first) end of each toggle link pin is supported by a side wall plate constituting a side surface of a crusher frame, and an inner (second) end is supported by a plate-shaped bracket standing on a cross member which connects the side wall plates on both sides. Since the first end of each toggle link pin is supported by the side wall plate, the toggle link pin can be pulled out from the side wall plate to the exterior, thereby facilitating maintenance.

[Patent Document] JP-A-2004-174450

DISCLOSURE OF THE INVENTION

Problems to be Solved by the Invention

Taking maintenanceability into consideration, the outer end of the toggle link pin is supported by the side wall plate, which happens to be provided with high strength as a portion of the crusher frame, so that the end can be supported with advantageous strength.

However, though a support structure can rigidly support the first end of the toggle link pin, since the inner second end is supported only by the plate-shaped bracket, the outer side and the inner side are not well-balanced with respect to strength, thereby requiring a thicker bracket for compensation, which is unsuitable for a compact jaw crusher that requires weight reduction.

An object of the present invention is to provide a jaw crusher which can keep maintenanceability by facilitating attachment and detachment of the toggle link pin and can support, in good balance, the outer side and inner side of the toggle link pin and a self-propelled crushing machine having such a jaw crusher.

Means for Solving the Problems

A jaw crusher according to an aspect of the present invention includes: a crusher frame that includes a pair of side wall plates and a rear wall plate and a cross member that connect the pair of the side wall plates; a fixed jaw attached to the rear wall plate; a swing jaw swingably hung between the side wall plates; and a reaction force-receiving link mechanism that includes: (i) a pair of toggle link pins having a first end pivoted on the side wall plate and a second end pivoted on a main supporter provided to the cross member, the pair of the toggle link pins being coaxially disposed, (ii) and (ii) a toggle link rotatably supported by the toggle link pins, in which the cross member on which the second end of the toggle link pin is pivoted is box-shaped.

In the above arrangement, it is preferable that the reaction force-receiving link mechanism includes a pair of lock cylinders whose pistons have a distal end that is rotatably coupled to the toggle link by way of a coupling shaft, the main supporter is provided to a side of the cross member adjacent to the swing jaw, and supporting portions that support cylinder bodies of the pair of the lock cylinders are provided to a side of the cross member opposite to the side to which the main supporter is provided.

In the above arrangement, it is preferable that the reaction force-receiving link mechanism includes a link plate having an end engaged to a rear portion of the swing jaw, and that a biasing mechanism that biases the link plate in a predetermined direction is provided to an outer side of the toggle link.

In the above arrangement, it is preferable that the reaction force-receiving link mechanism includes a pair of arms that supports the other end of the link plate and is rotatably supported by the pair of the toggle link pins, in which a coupling center of the lock cylinder relative to the coupling shaft is displaced axially inward with respect to a support center of the arm relative to the toggle link pin, and the biasing mechanism is disposed in a space created by the displacement between the side wall plates and the toggle link.

In the above arrangement, it is preferable that a self-propelled crushing machine includes the jaw crusher.

EFFECTS OF THE INVENTION

According to the aspect of the present invention as mentioned above, the outer end of the pair of the toggle link pins that support the toggle link is securely pivoted on the side plate, and the inner end is also securely pivoted not on a conventional plate-like bracket of a cross member but on the highly rigid, box-shaped main supporter integrally provided to the cross member, so that both ends of the toggle link pin can be supported well-balanced in strength without additional reinforcement, thereby enabling weight reduction. Obviously, since the outer end of each of the toggle link pins is supported by the side wall plate, the toggle link pin can be pulled out from the side wall to the exterior by removing the toggle link pin from the side wall plate, thereby still allowing easy maintenance.

According to the aspect of the present invention, as described above, since the cross member is formed box-shaped and high in rigidity, the cross member can serve as a supporting portion for the lock cylinders, so that there is no need for additional components to support the lock cylinders, thereby reducing the number of components constituting the jaw crusher.

According to the aspect of the present invention, since the biasing mechanisms are provided to the outer sides of the toggle link, the biasing mechanisms can be adjusted from the exterior of the jaw crusher, thereby facilitating adjustment.

According to the aspect of the present invention, the coupling center of the lock cylinder at the coupling shaft and the support center of the toggle link pin on the toggle link are misaligned to provide a space to dispose the biasing mechanism, so that the biasing mechanisms can be efficiently disposed to both sides of the toggle link, thereby providing secure support to the link plate.

According to the aspect of the present invention, functions and effects similar to the above-mentioned aspects of the invention can be obtained by installation of the jaw crusher according to the above-mentioned aspects of the present invention.

BEST MODE FOR CARRYING OUT THE INVENTION

Brief Description of Overall Arrangement

An embodiment of the present invention will be described below with reference to the figures.

Figure 1:
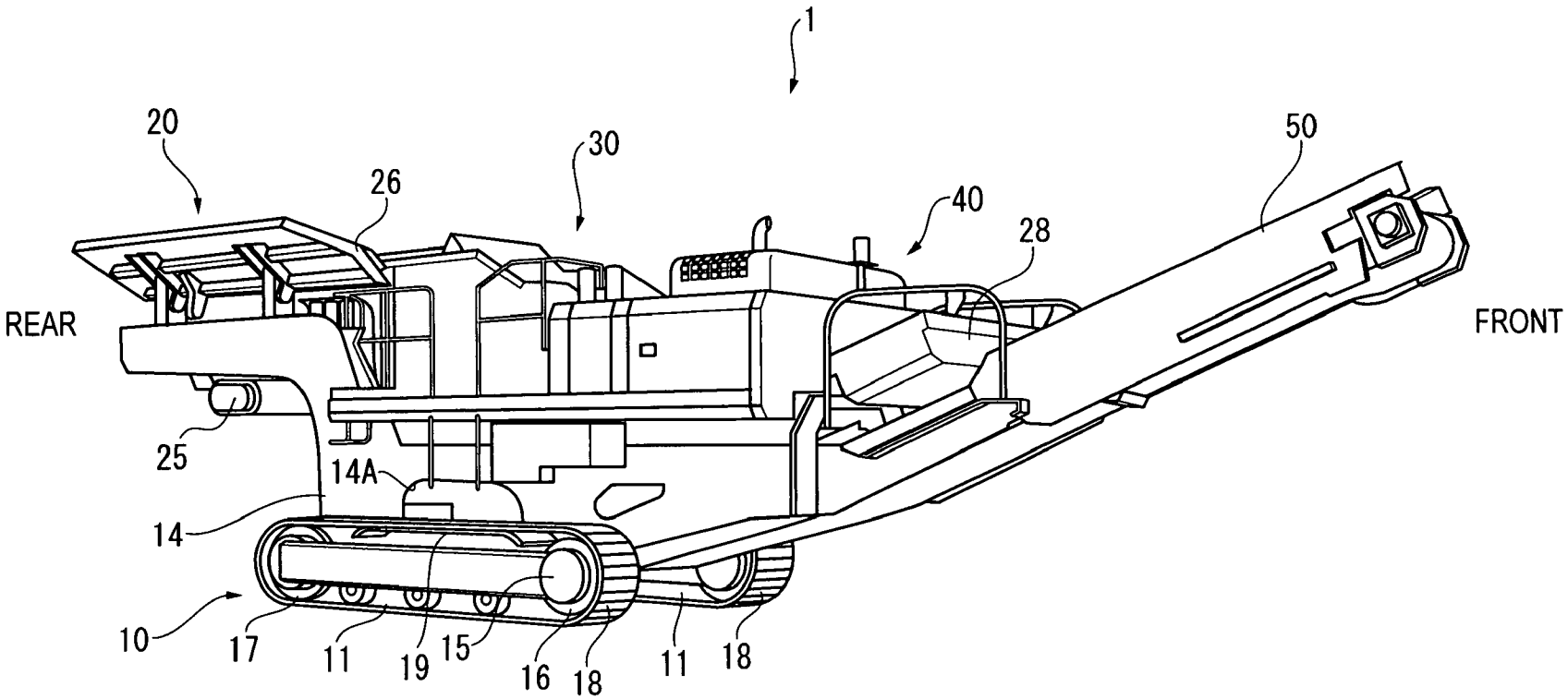
FIG. 1 is a perspective view showing a self-propelled crushing machine according to an embodiment of the present invention.

FIG. 1 is a perspective view showing a self-propelled crushing machine 1 according to the embodiment. For the convenience of explaining the embodiment, the right side of FIG. 1 will be referred to as a front side and the left side as a rear side.

The self-propelled crushing machine 1 includes: a main unit 10 having a pair of lower traveling members 11; a feed unit 20 that is provided to a rear portion of an upper surface of the main unit 10 and supplied with raw materials; a jaw crusher 30 provided in front of the feed unit 20; a power unit 40 provided in front of the jaw crusher 30; and a discharge conveyor 50 extending forward and obliquely upward from a lower portion of the main unit 10 between a pair of crawlers 18.

The main unit 10 has a main frame (track frame) 14 including left and right side frames each continuous in the longitudinal direction and a plurality of link frames linking the side frames to each other. The lower traveling members 11 are respectively attached on the lower sides of the side frames. The lower traveling member 11 is constructed in an arrangement in which the crawler 18 is wound around a front sprocket wheel 16 driven by a hydraulic motor 15 and a rear idler tumbler 17.

The lower traveling member 11 of the present embodiment is not provided with upper rolling wheels. In the upper side of the lower traveling member 11, the crawler 18 is guided sliding on a metallic guide plate with superior wear resistance. Accordingly, in the upper side of the lower traveling member 11, the height level of the crawler 18 is lower than conventional models and the crawler 18 is substantially horizontal. Consequently, a maintenance opening 14A provided to a side surface of the main frame 14 as an entrance into the interior is opened at a lower position as compared to conventional models, and the height of the main frame 14 is also set low. However, because the height from the upper surface of the discharge conveyor 50 to the bottom surface of the jaw crusher 30 is determined, the installation height of the jaw crusher 30 itself is substantially the same as that of conventional one. From another standpoint, the capacity of the main frame 14 which houses the lower portion of the jaw crusher 30 decreases as the height of the main frame 14 decreases, correspondingly increasing the portion of the jaw crusher 30 exposed to the exterior. A larger exposed portion reduces work that requires entry into the maintenance opening 14A, thereby facilitating maintenance.

In the feed unit 20, a grizzly feeder (not shown) driven by a vibrator 25 is mounted via a plurality of coil springs on the upper side of the frame protruding rearward. A hopper 26 is provided to the upper side of the grizzly feeder, covering the feeder from its three sides. Raw materials are thrown into the hopper 26 whose opening widens upward. Provided below the grizzly feeder is a discharge chute (not shown) which guides raw materials sorted and dropped by a grizzly feeder to the discharge conveyor 50 below.

As shown in FIG. 1, the power unit 40, on which an engine, a hydraulic pump, a fuel tank, an operating oil tank and the like are mounted via suitable mounting brackets and cross members, is mounted on a main frame 14. A control valve housed in a housing space of the power unit 40 distributes the hydraulic pressure from the hydraulic pump to the hydraulic motor in the lower traveling member 11, the vibrator 25 for the grizzly feeder, the hydraulic motor of the jaw crusher 30, a hydraulic motor for driving the discharge conveyor 50 and the like.

The discharge conveyor 50 discharges forward crushed materials dropped from the outlet of the jaw crusher 30 and drop them from a height. The dropped crushed materials are, for example, accumulated. If the raw materials contain foreign substances such as rebar and metal chips, a magnetic separator 28 (see FIG. 1) can be mounted in front of the discharge conveyor 50 to remove the foreign substances. Instead of accumulating crushed materials from the discharge conveyor 50 on the ground, crushed materials may be carried to a remote place by secondary and tertiary conveyors and the like.

As shown in FIGS. 2 to 6, the jaw crusher 30 has a crusher frame 34 in which left and right side wall plates 31 are linked to each other by a rear wall plate 32 reinforced by a plurality of ribs and a cross member 33. A fixed jaw 35 is attached to the inner surface of the rear wall plate 32, and a swing jaw 36 whose tooth surface stands substantially vertically is disposed opposite to the fixed jaw 35. The swing jaw 36 is hung at an upper side thereof on an eccentric portion of a main shaft 37 rotatably bridged between the side wall plates 31, supported at a lower side thereof by a reaction force-receiving link mechanism 60 for receiving reaction force generated by crushing, and biased constantly toward the reaction force-receiving link mechanism 60 by a biasing mechanism 70.

The reaction force-receiving link mechanism 60 includes a link plate 61 having a first end engaged on a rear part of the swing jaw 36, a toggle link 64 that supports a second end of the link plate 61 and rotates about a toggle link pin 63, and lock cylinders 65 having lower ends pivoted on the toggle link 64. Each lock cylinder 65 is rotatably pivoted on the side of the cross member 33. An outlet gap W between the lower ends of the jaws 35 and 36 can be adjusted by advancing and retracting rods 66 of the lock cylinders 65. In other words, the reaction force-receiving link mechanism 60 constitutes an outlet gap-adjusting link mechanism 62 in which the lock cylinders 65 are driven to move the swing jaw 36 toward and away from the fixed jaw 35 via the toggle link 64 and the link plate 61.

Figure 5:
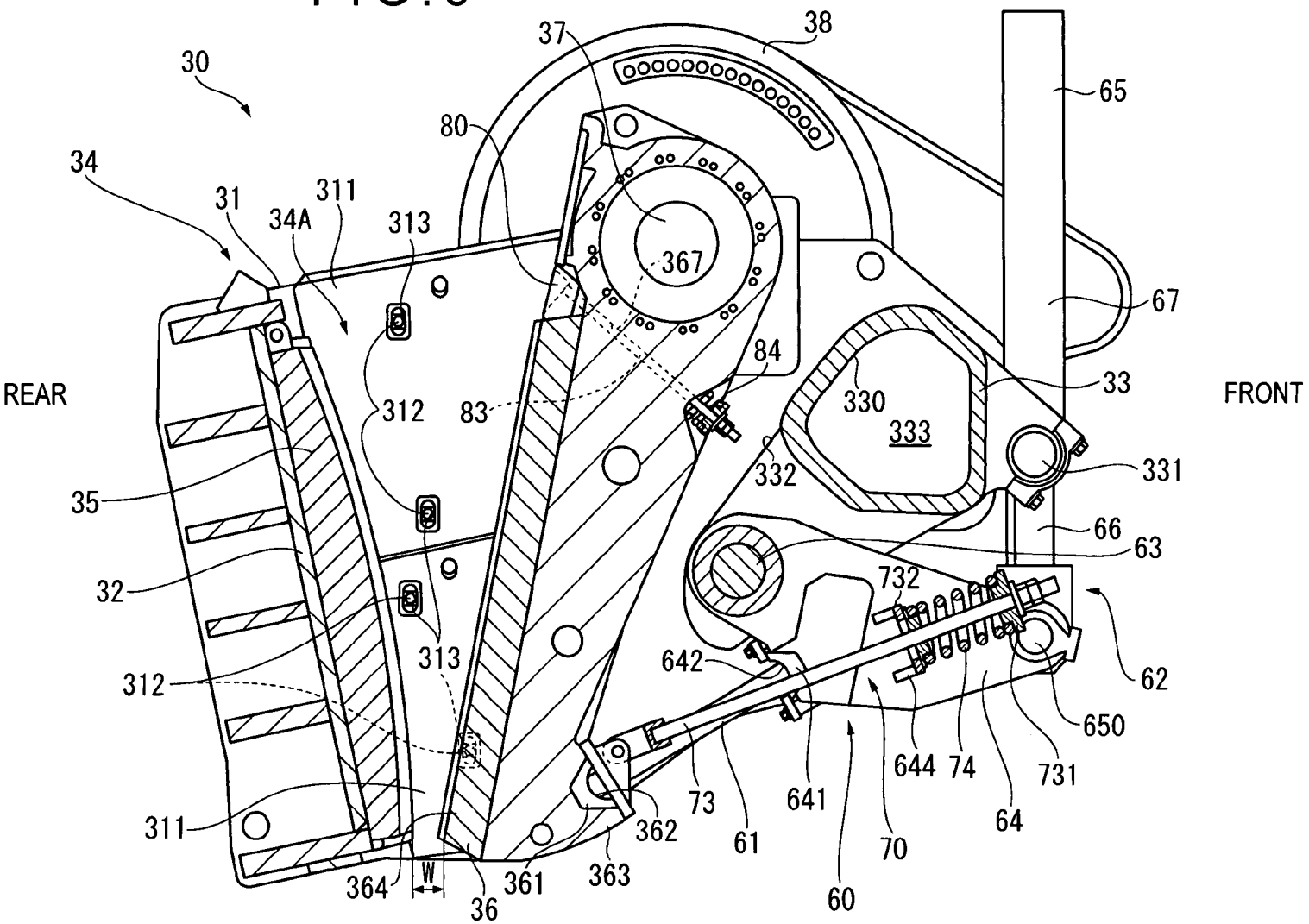
FIG. 5 is a side sectional view of the jaw crusher according to the embodiment.

The biasing mechanism, a pair of which are disposed at two opposing sides of the reaction force-receiving link mechanism 60, substantially consists of a tension rod 75 having an end pivoted on the side of the swing jaw 36 and a tension spring 74 biasing the tension rod 73 in a predetermined direction, as shown FIG. 5. The tension rod 73 and the tension spring 74 are attached to the above mentioned toggle link 64.

In the jaw crusher 30 as described above, a crush chamber 34A is formed by the region surrounded by the fixed jaw 35, the swing jaw 36 and the crusher frame 34, and when a pulley 38 provided to an end of the main shaft 37 is driven by a hydraulic motor via a V-belt, the swing jaw 36 functions as a swinging link via the rotation of the main shaft 37 and crushes raw materials in the crush chamber 34A between the fixed jaw 35 and the swing jaw 36. Meanwhile, in the jaw crusher 30 according to the embodiment, the reaction force-receiving link mechanism 60 adopts a down-thrust type mechanism, so that the swing jaw 36 swings upward from downside on approaching the tooth surface of the fixed jaw 35.

Detailed Description of Jaw Crusher

The details of the jaw crusher 30 will be explained below.

In FIGS. 2 to 6, the jaw crusher 30 has the fixed jaw 35 fixed to the rear wall plate 32, and the swing jaw 36 which swings relative to the fixed jaw 35, as described above. Provided on the rear surface of the swing jaw 36 are the reaction force-receiving link mechanism 60 which receives reaction force from the swing jaw 36, and the biasing mechanism 70 which biases the swing jaw 36 with a predetermined biasing force toward the reaction force-receiving link mechanism 60.

The reaction force-receiving link mechanism 60 includes a link having the link plate 61, the toggle link 64, and the lock cylinders 65, as described above.

Figure 3:
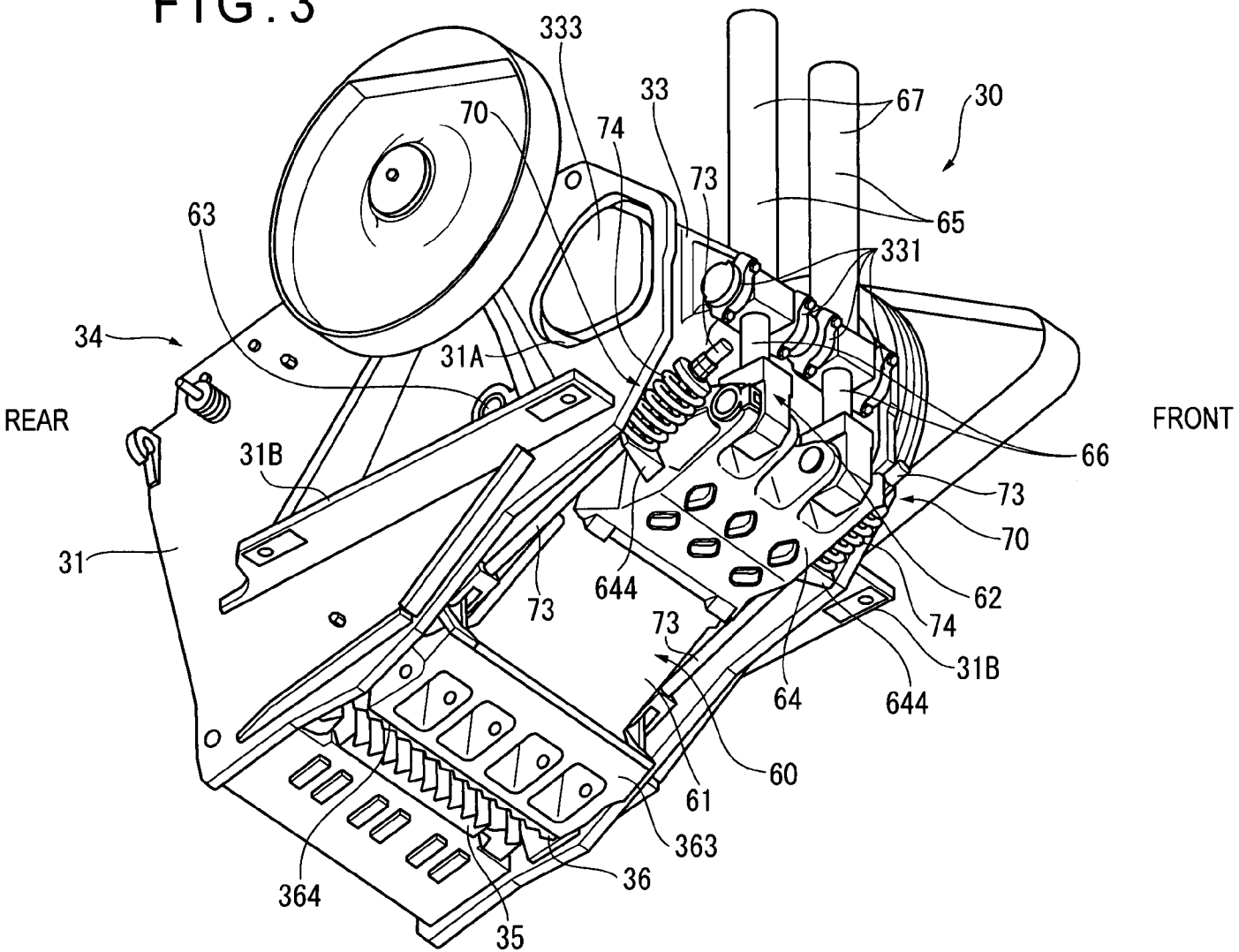
FIG. 3 is a perspective view of the jaw crusher according to the embodiment.

As shown in FIG. 3, the link plate 61 is a plate-shaped member which contacts the rear surface of the swing jaw 36 throughout substantially overall width of the swing jaw 36. The link plate 61 contacts the swing jaw 36 in an oblique downward direction from upside, so that the reaction force-receiving link mechanism 60 is of the down-thrust type. As shown in FIG. 3, an end of the link plate 61 contacts a contact portion 361 provided on the rear surface of the swing jaw 36. The other end of the link plate 61 contacts contact portions 641 provided on the toggle link 64. Thus, the link plate 61 is pinched and supported between the swing jaw 36 and the toggle link 64. Concave portions 362 and 642 each having a substantially arc-like section are formed on the contact portions 361 and 641. The link plate 61 can swing about swinging centers which are the centers of the arcs of the concave portions 362 and 642.

The toggle link 64 provided inside the side wall plates 31 integrally includes an attachment portion 644 to which the tension spring 74 is attached. The toggle link 64 is pivoted on the toggle link pin 63.

Each of the lock cylinders 65 is provided in front of the toggle link 64 and provided with the rod 66 and a cylinder body 67 for advancing and retracting the rod 66. Each lock cylinder 65 is arranged to stand with the rod 66 situated in the lower side of the cylinder body 67. The lower ends of the rods 66 are respectively pivoted on the front ends of the toggle link 64. A portion of each cylinder body 67 near the end thereof through which the rod 66 advances and retracts, i.e., the lower side (head side) of the cylinder body is rotatably supported by a support portion 331 of the cross member 33.

In each of these lock cylinders 65, the rod 66 or a piston at an end of the rod 66 interference-fits the cylinder body 67, and both of the rod 66 and the cylinder body 67 are usually locked. If hydraulic pressure is applied to the interference-fitted portions through the rods 66, the circumferential walls of the cylinder bodies 67 expand, reducing resistance between the cylinder bodies 67 and the rods 66. The lock is then released so that the rods 66 can advance and retract relative to the cylinder bodies 67. Therefore, the rods 66 can be locked at any suitable position in the cylinder bodies 67.

According to the reaction force-receiving link mechanism 60, the reaction force generated when raw materials are crushed is received by the toggle link pin 63 of the toggle link 64 and the support portions 331 of the cross member 33 via the link plate 61. As described above, if hydraulic pressure is applied between the pistons and the cylinder bodies 67 of the lock cylinders 65 to release the lock and if the rods 66 are advanced and retracted, the swing jaw 36 is moved toward and away from the fixed jaw 35 via the toggle link 64 and the link plate 61. In short, the reaction force-receiving link mechanism 60 also functions as the outlet gap-adjusting link mechanism 62.

As shown in FIG. 5, a pair of the biasing mechanisms 70 are provided to both outer sides of the toggle link 64, or in other words, to both sides in width direction of the swing jaw 36. As mentioned above, the biasing mechanism 70 includes the tension rod 73 and the tension spring 74.

A first end of the tension rod 73 is attached to the swing jaw 36. A second end of the tension rod 73 is arranged to penetrate the attachment portion 644 of the toggle link 64 into a forward and obliquely upward direction with respect to the position of the attached first end. The tension rod 73 is inserted into the tension spring 74, whose top end contacts a contact portion 731 screwed on the tension rod 73 and bottom end contacts a contact portion 732 fixed to the attachment portion 644, thereby biasing the tension rod 73 toward the toggle link 64 with a predetermined biasing force (tension). In short, the tension spring 74 biases the swing jaw 36 toward the toggle link 64 via the tension rod 73. This biasing force steadily holds the link plate 61 between the swing jaw 36 and the toggle link 64.

On the inner surface of the side wall plate 31, a cheek plate 311 is attached to the substantially triangular region between the fixed jaw 35 and the swing jaw 36. The cheek plate 311 is formed in a plate of predetermined thickness, which is divided into upper and lower plates. At both widthwise ends of the of the fixed jaw 35, projections 39 (FIG. 7) for guiding the cheek plate 311 are obliquely formed, downwardly approaching the swing jaw 36. The cheek plate 311 is contacted to and guided by the projection 39 to roughly determine position thereof with respect to the side wall plate 31 and is mounted on the side wall plate 31 by a mounting bolt 312. A head of the mounting bolt 312 is housed in a notch 313 formed on the cheek plate 311 so as not to project from the surface of the cheek plate 311, thereby reducing direct rubs between raw material and the mounting bolt 312.

Figure 4:
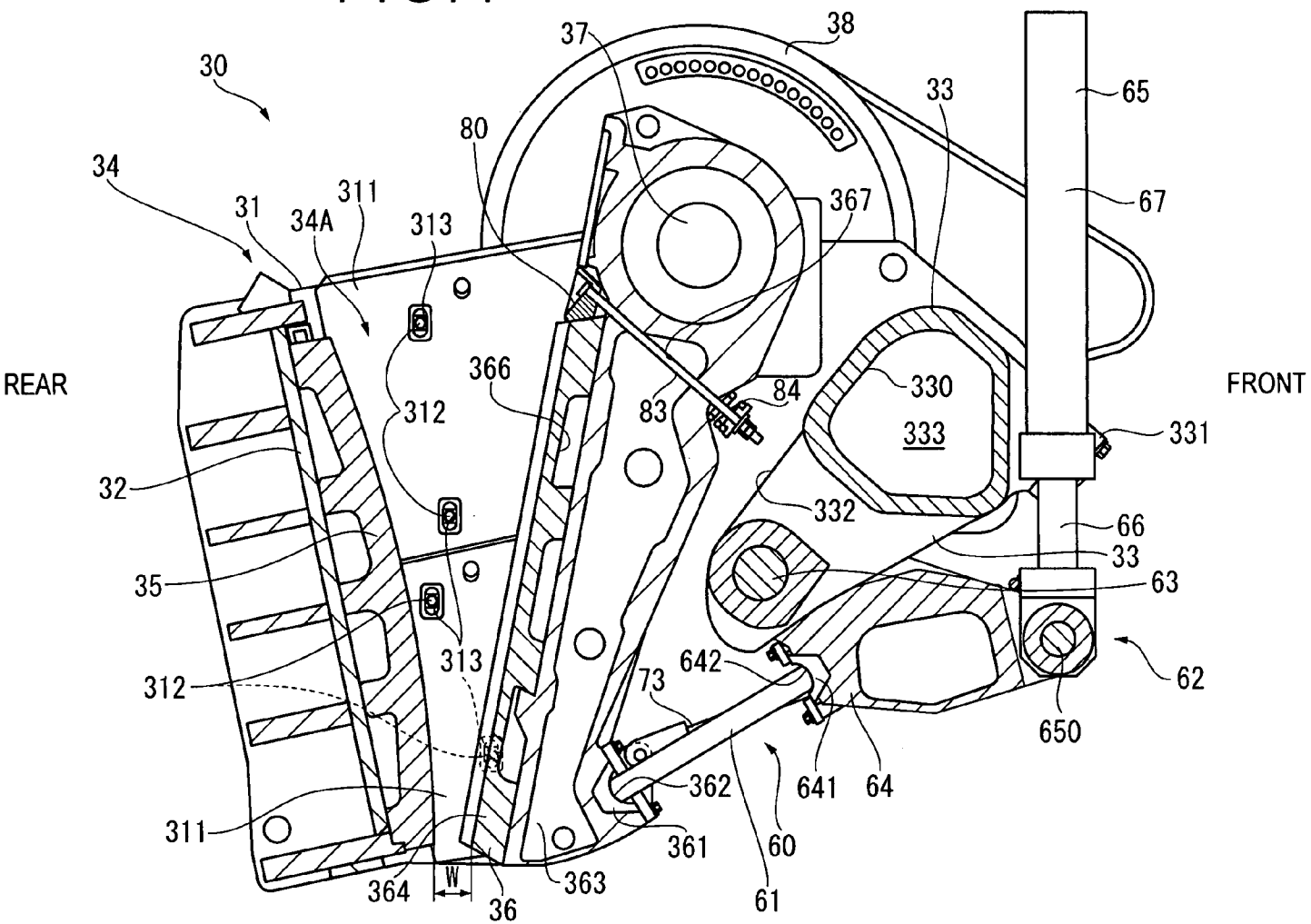
FIG. 4 is a side sectional view of the jaw crusher according to the embodiment.
Figure 6:
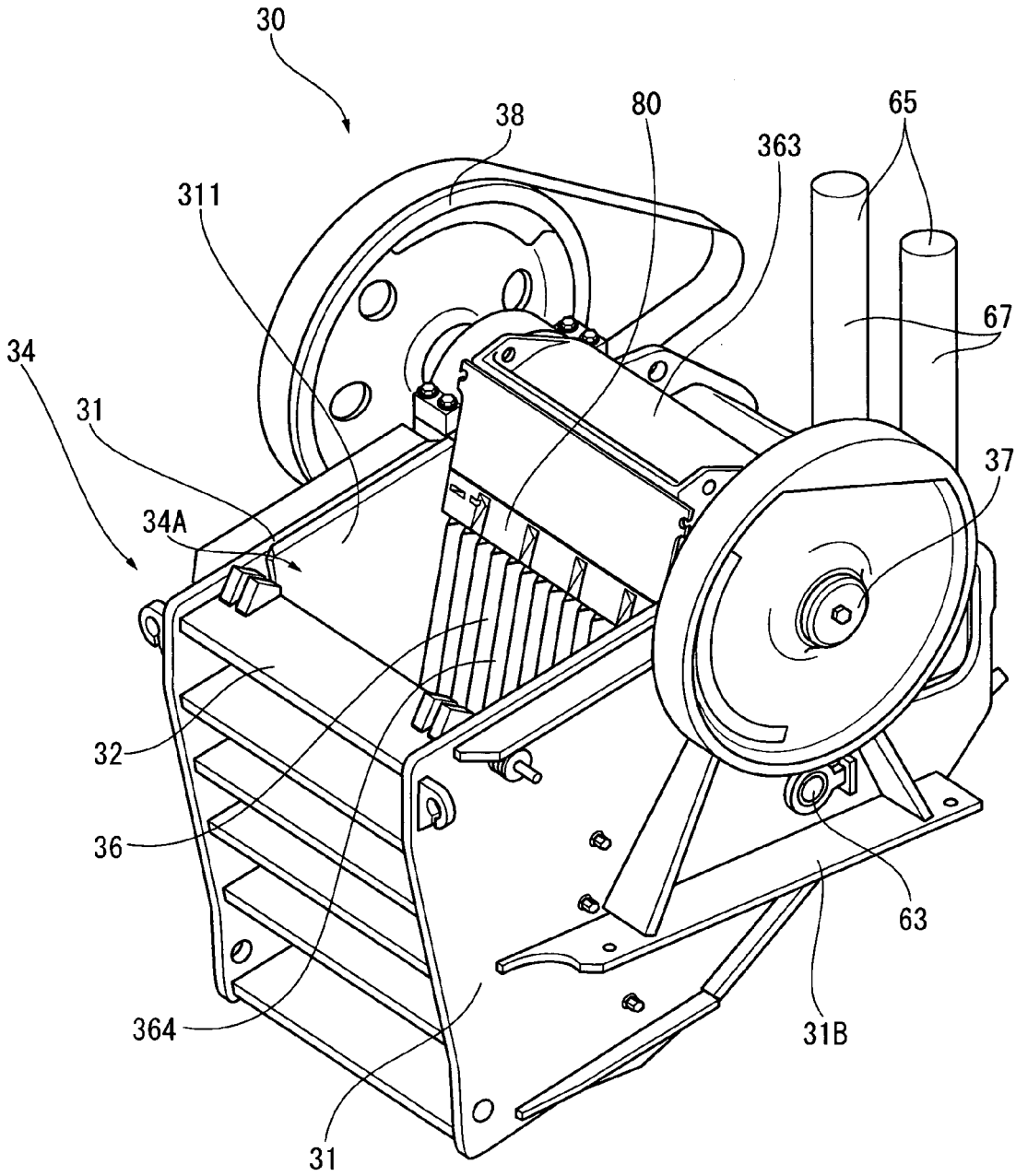
FIG. 6 is a perspective view of the jaw crusher according to the embodiment.

The swing jaw 36 includes a swing jaw body 363 supported rotatably with respect to the main shaft 37 and moving teeth 364 attached to the swing jaw body 363. As shown in FIGS. 4 to 6, a wedge 80 for fixing the moving teeth 364 to the swing jaw body 363 is provided between the moving teeth 364 and the swing jaw body 363. A wedge bolt 83 that penetrates the swing jaw body 363 to the side opposite to the surface on which the wedge 80 is mounted is inserted in the wedge 80. The wedge 80 is biased toward the swing jaw body 363 by a spring 84 attached to a distal end of the wedge bolt 83.

Detailed Description of Toggle Link Support Structure

Hereinafter, a support structure at the crusher frame 34 of the toggle link 64 constituting the reaction force-receiving link mechanism 60 will be described.

Figure 7:
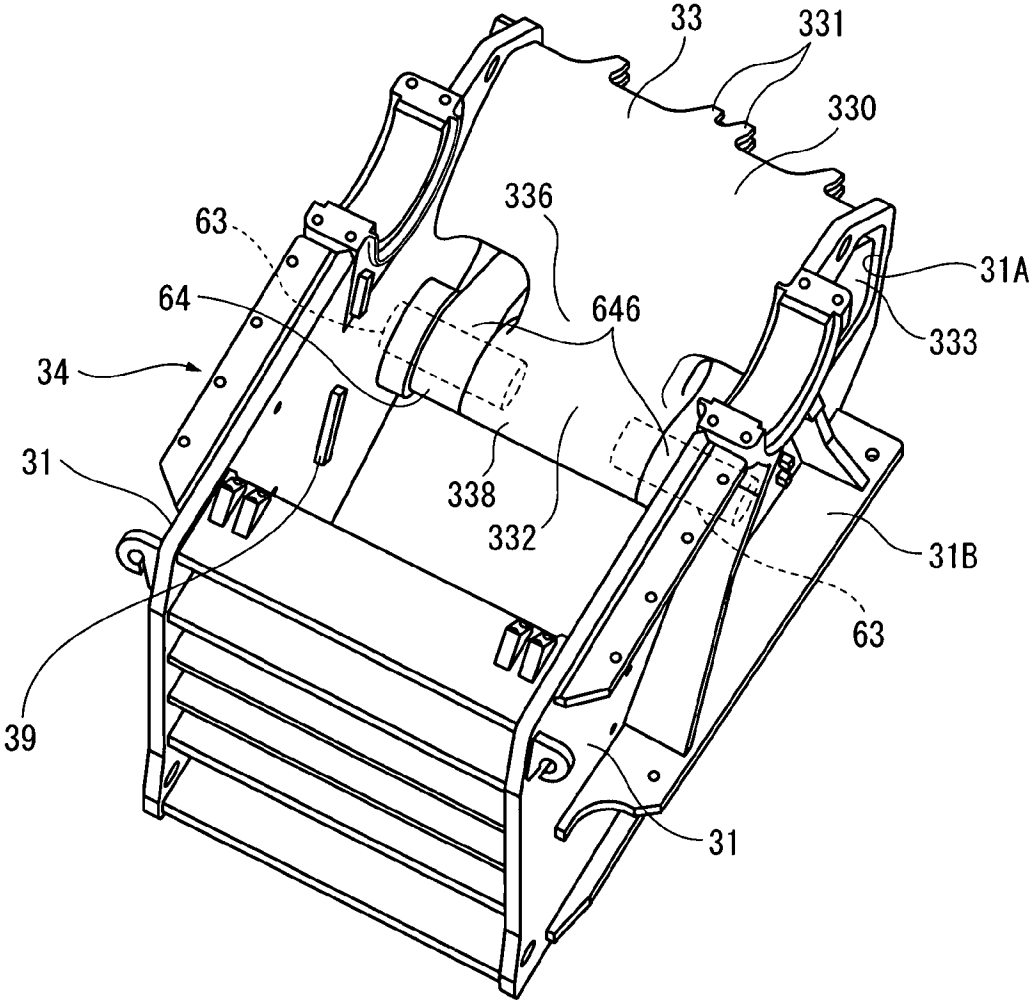
FIG. 7 is a perspective view of a crusher frame assembled with a toggle link according to the embodiment.
Figure 8:
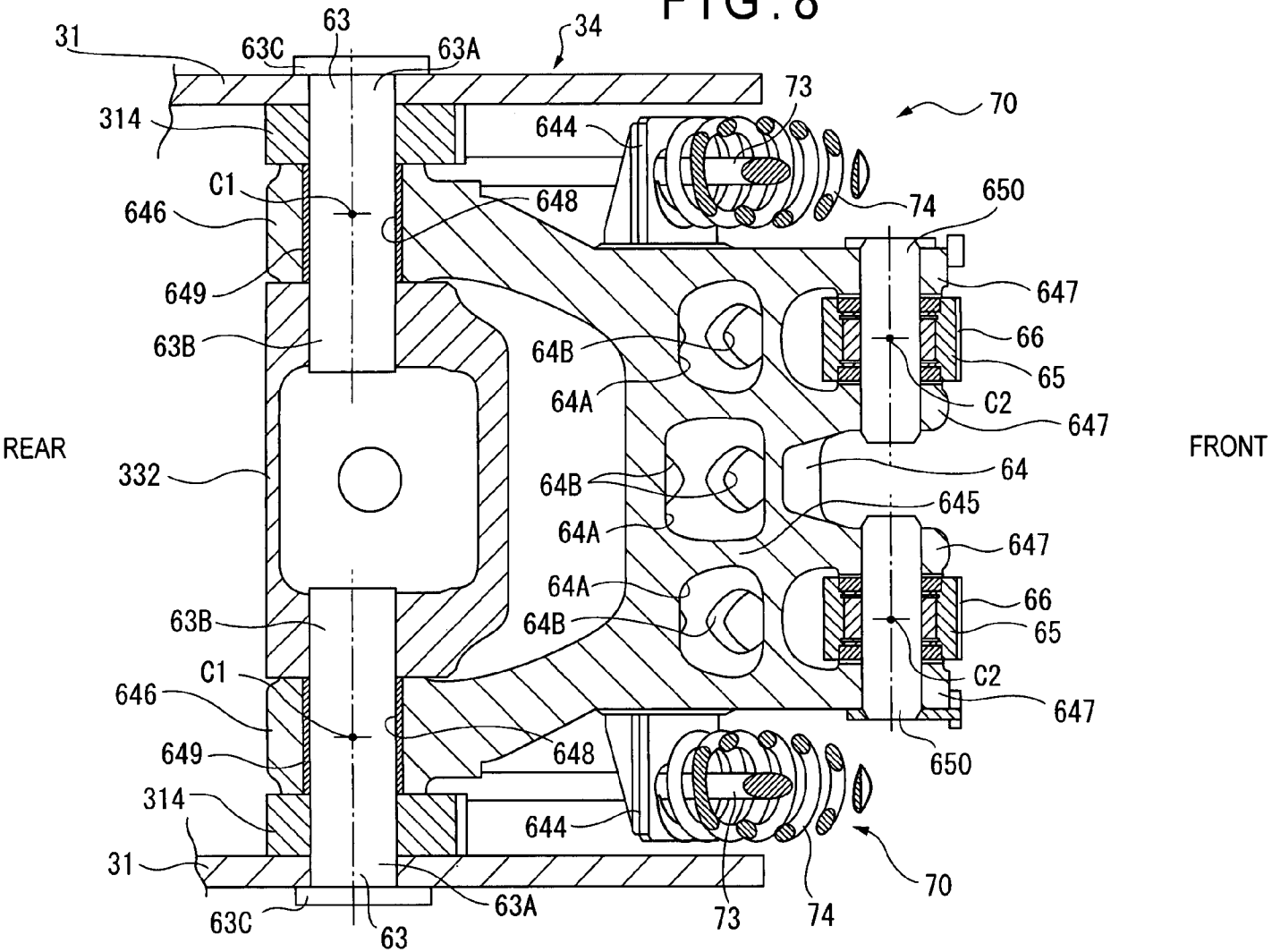
FIG. 8 is a sectional view of the primary portion of the crusher frame and the toggle link, which is taken along VIII-VIII line in FIG. 2.
Figure 9:
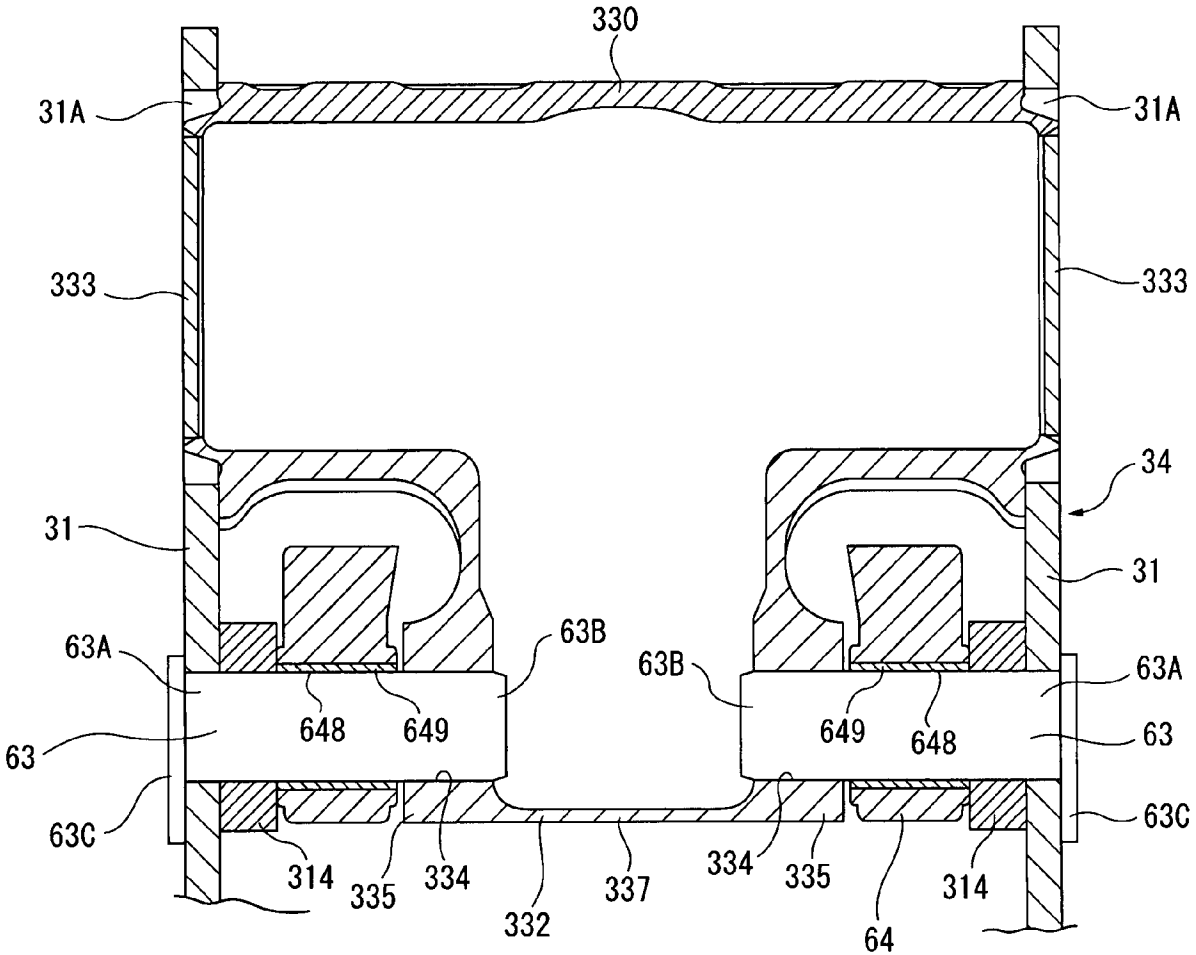
FIG. 9 is a sectional view of the crusher frame and the toggle link from another angle, which is taken along IX-IX line in FIG. 2.
Figure 10:
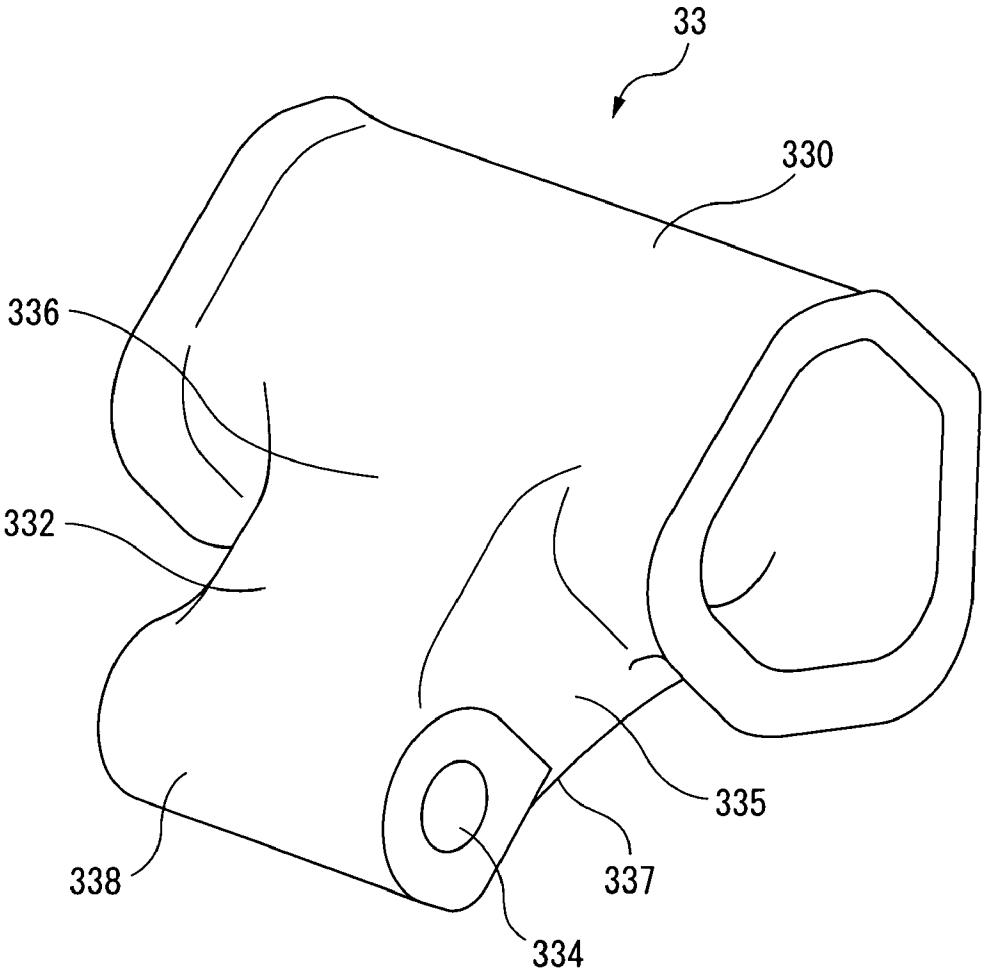
FIG. 10 is a perspective view showing a whole of a cross member that constitutes the crusher frame.

FIG. 7 is a perspective view of the crusher frame 34 assembled with the toggle link 64 according to the embodiment. FIG. 8 is a sectional view of the primary portion of the crusher frame 34 and the toggle link 64, which is taken along VIII-VIII line in FIG. 2. FIG. 9 is a sectional view of the crusher frame 34 and the toggle link 64 from another angle, which is taken along IX-IX line in FIG. 2. FIG. 10 is a perspective view showing a whole of the cross member 33 that constitutes the crusher frame 34.

As shown in FIGS. 7 to 10, the crusher frame 34 includes a pair of the side wall plates 31, the rear wall plate 32 for connecting the side wall plates 31 and the cross member 33. A pair of the toggle link pins 63 for pivoting the toggle link 64 are serially provided on a common widthwise axis of the crusher frame 34. An outer end 63A of each of the toggle link pin 63 is pivoted on the side wall plate 31 of the crusher frame 34, and an inner end 63B is pivoted on a portion of the cross member 33. A support block 314 that can spare sufficient length to support the end 63A of the toggle link pin 63 is fixed to the inner side of the side wall plate 31 by welding and the like.

Figure 2:
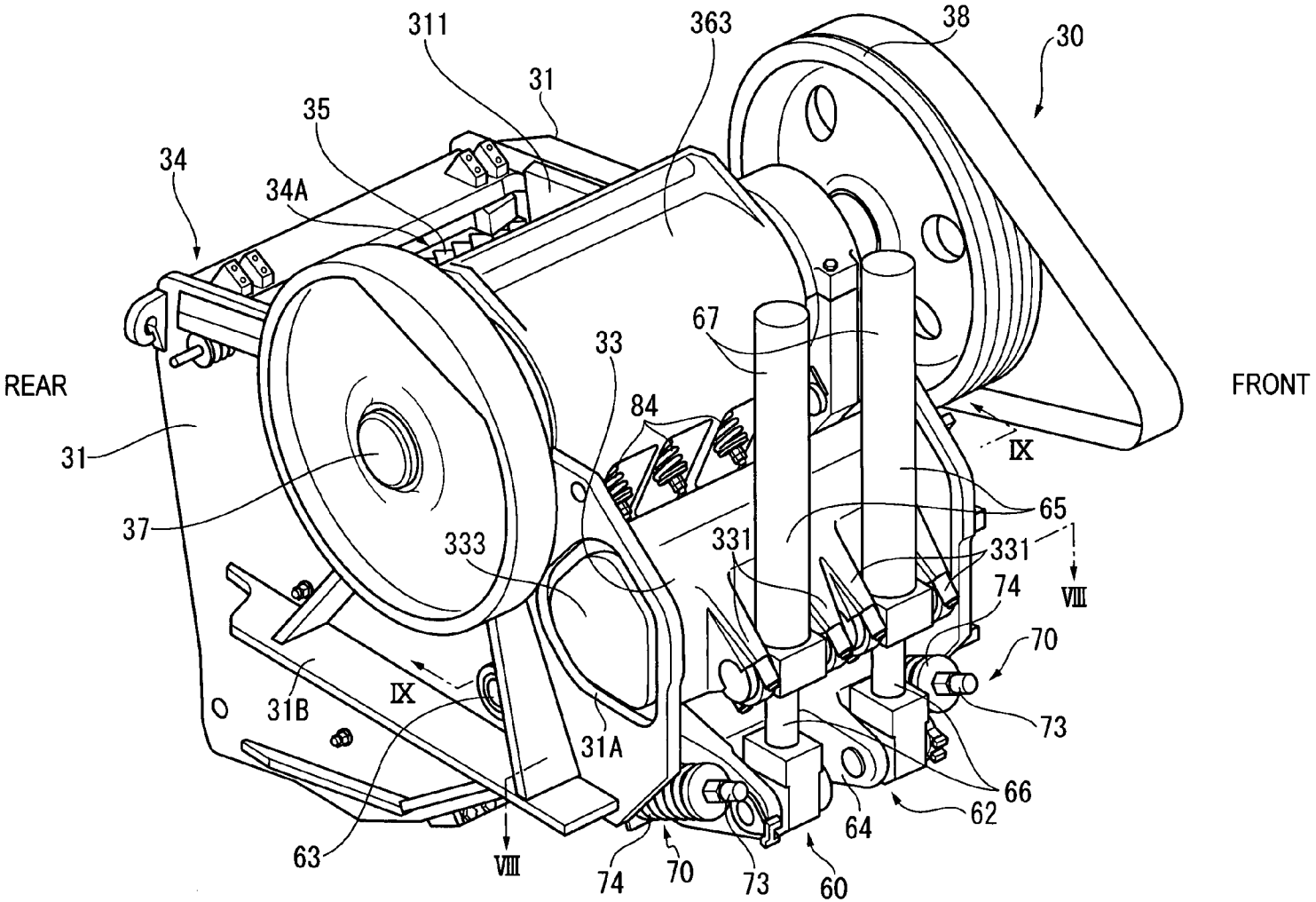
FIG. 2 is a perspective view of a jaw crusher according to the embodiment.

A flange 63C of the outer end 63A of the toggle link pin 63 is fixed to the side of the side wall plate 31 by a bolt. The toggle link pin 63 can be pulled out to the exterior by removing the bolt and can also be inserted from the exterior. In other words, as shown in FIGS. 2, 3 and 6, the toggle link pin 63 is disposed above a mounting rib 31B provided on the side wall plate 31. When the jaw crusher 30 is mounted by mounting the mounting rib 315 on the upper portion of the main frame 14, the toggle link pin 63 is exposed to a position allowing attachment and detachment thereof from the exterior.

The toggle link 64 is a cast with a hollow portion, which includes: a body 645 whose upper surface has an opening for weight reduction and lower surface has an opening 64B for sand removal; a pair of arms 646 extending forward from the body 645; and a support piece 647 extending substantially straight rearward from the body 645.

The body 645 is disposed substantially in the middle of the side wall plates 31. Between the body 645 and the left and right side wall plates 31, spaces sufficient to dispose tension rods 73 of the biasing mechanisms 70, tension springs 74 and attachment portions 644 for attaching the tension rods 73 and the tension springs 74 are reserved.

The arms 646 extend forward and widthwise, and the distal ends of the arms 646 are supported by the toggle link pins 63. In other words, the support holes 648 are provided to the distal ends of the arms 646, the toggle link pins 63 are inserted into the support holes 648 via the liners 649.

The coupling shaft 650 to which the lower ends of the rods 66 of the lock cylinders 65 (FIG. 8) are coupled are inserted into the support pieces 647.

Accordingly, since the arms 646 extend forward and widthwise with respect to the body 645 and the support pieces 647 extend straight forward, the coupling centers C2 of the coupling shafts 650 are located inward relative to the support centers C1 of the toggle link pins 63, so that the misalignment of the centers C1 and C2 allows reservation of spaces on both sides for disposing the above-mentioned biasing mechanisms 70. By providing the biasing mechanisms 70 to both sides of the toggle link 64, the link plate 61 (FIG. 3) can be properly supported at both widthwise ends, so that an eccentric load that originates from crushing is less likely to generate force that twists the toggle link 64, thereby stabilizing the link plate 61.

The cross member 33 is also a hollow cast and includes: a tubular body 330 that is fitted to the attachment opening 31A provided to the side wall plates 31 on both sides and then, for example, welded around; and a main supporter 332 that extends obliquely downward from the body 330 and supports the inner ends 63B of the toggle link pins 63. As shown in FIG. 9, openings 330A on both sides of the body 330 are sealed, for example, by welding seal plates 333. As already mentioned, the support portion 331 for supporting the lock cylinders 65 are provided to the rear side of the body 330.

In such a wholly hollow cross member 33, the main supporter 332 for supporting the toggle link pin 63 is formed in a box to improve rigidity around the support hole 334 provided to the main supporter 332. More specifically, the main supporter 332 includes both side surfaces 335 having the support holes 334, an upper surface 336 covering an area between the upper ends of the side surfaces 335, and a lower surface 337 covering an area between the lower ends of the side surfaces 335. The upper surface 336 and the lower surface 337 are continuously connected via a curved surface 338 at the front side. Due to such an improvement in rigidity, the support strengths of the inner end 63B and the outer end 63A of the toggle link pin 63 are substantially equalized, so that the ends 63A and 63B of the toggle link pin 63 are supported in a well-balanced manner.

Since the main supporter 332 is box-shaped and high in rigidity, providing thickness around the support hole 334 on the side surface 335 to support the toggle link pin 63 is sufficient, so that other portions, i.e., the upper surface 336, the lower surface 337 and the curved surface 338 can be formed thinner compared to the thickness around the support hole 334 on the side surface 335 to enable weight reduction. In addition, the entirely hollow cross member 33, despite overall deformed box shape thereof, enables weight reduction by overall thinning of the surfaces and high rigidity. Therefore, twist or the like of the cross member 33 on account of the reaction force generated by crushing can be securely prevented, thereby improving the preciseness of the crushed particle size.

Further, since the coupling center C2 at the coupling shaft 650 of the lock cylinder 65 takes an inner position relative to the support center C1 of the toggle link pin 63, in the cross member 33 over the coupling center C2, the distance between the two support portions 331 supporting the lock cylinders 65 are shortened, thereby averaging external force inputted to each of the pair of the lock cylinders 65 to eliminate induction of excessive slides of the lock cylinders 65. Furthermore, although loads are likely to concentrate due to the shortened distance between the two support portions 331 of the cross member 33, since the cross member 33 is extremely high in rigidity owing to the overall box shape thereof, durability against such loads is ensured and flexure of the crusher frame 34 is restrained, thereby curbing variations in the crushed particle size.

Operation of Jaw Crusher

The operation of the jaw crusher 30 will be explained below.

At this time, since the swing jaw 36 is supported at its lower side by the reaction force-receiving link mechanism 60 of the down-thrust type, the link plate 61 swings about the arc center of the concave portion 642 on the side of the toggle link 64 so that the swing jaw 36 swings to move toward and away from the fixed jaw 35. By this swinging movement, the swing jaw 36 and the fixed jaw 35 crush raw materials thrown between them and discharge crushed materials to the discharge conveyor 50 from the outlet gap W between the lower ends.

The reaction force received when the swing jaw 36 crushes raw materials is received by the toggle link pin 63 of the toggle link 64 and the support portion 331 of the cross member 33. If the reaction force received by the swing jaw 36 is too large, the interference-fitted portions of the lock cylinders 65 slide to prevent damages to the main portions of the jaw crusher 30.

Meanwhile, to change the particle size of crushed materials, the outlet gap-adjusting link mechanism 62 is operated. Hydraulic pressure is applied between the piston and the cylinder body 67 of the lock cylinder 65 to slightly expand the cylinder body 67 to reduce resistance therebetween and release the interference-fitted lock. When the rod 66 is advanced and retracted in this state by applying hydraulic pressure to the head side or bottom side of the cylinder body 67, the toggle link 64 rotates about the toggle link pin 63 in response. The link plate 61 then changes position thereof, so that the swing jaw 36 moves toward and away from the fixed jaw 35. The outlet gap W between the lower ends of the swing jaw 36 and the fixed jaw 35 is thus adjusted to change the particle size of the crushed materials.

When a necessity arises to remove the toggle link 64 from the crusher 30 to conduct maintenance, first, the toggle link 64 is supported by a temporary stand or the like to allow removal of the biasing mechanism 70, and then the coupling shaft 650 to which the lower portion of the lock cylinder 65 is coupled is pulled out to the outer side to release the coupling. Next, the toggle link pin 63 is pulled out to the outer side to be left in a free state. Subsequently, the toggle link 64 is displaced backward together with the temporary stand. The procedure is reversed to attach the toggle link 64. As described, maintenance can be conducted by removing only the toggle link 64 without removing the whole jaw crusher 30 from the main frame 14.

It should be noted that the present invention is not limited to the above embodiment, but includes other arrangements that can achieve an object of the present invention, and modifications described below are also included in the present invention.

For example, in the above embodiment, the coupling center C2 at the coupling shaft 650 of the lock cylinder 65 took a position inner relative to the support center C1 of the toggle link pin 63, but an arrangement in which the centers C1 and C2 share a position with respect to left-right direction (width direction) is included in the present invention. However, when the centers C1 and C2 take a common position, disposing the biasing mechanisms on both sides of the toggle link 64 requires increasing a distance between the side wall plates 31 and a length of the toggle link pin 63, thereby leading to upsizing. Accordingly, from a viewpoint to promote downsizing, the centers C1 and C2 are preferably displaced to dispose the biasing mechanisms 70 in the space created by the displacement.

The best arrangements, methods and the like for implementation of the present invention is disclosed above, but the present invention is not limited to such. That is to say, though the present invention is specifically shown in figures and explained mainly with regard to a particular embodiment, those skilled in the art can variously modify the shape, amount and other detailed arrangements of the above embodiment without departing from the technical ideas and scope of the objects of the present invention.

Therefore, because the above-disclosed description limiting the shape, amount and the like is merely an exemplified statement for facilitating understanding of the present invention and is not a limitation on the present invention, a statement using names of the members on which a part of or all of the limitations regarding the shape, amount and the like is eliminated is included in the present invention.

The invention claimed is:

1. A jaw crusher, comprising:

a crusher frame that comprises a pair of side wall plates, a rear wall plate and a cross member that connects the pair of side wall plates;

a fixed jaw attached to the rear wall plate;

a swing jaw swingably hung between the side wall plates; and a reaction force-receiving link mechanism that comprises:

(i) a pair of toggle link pins respectively having a first end pivoted on each of the pair of side wall plates and a second end pivoted on a main supporter provided to the cross member, the pair of toggle link pins being coaxially disposed, and (ii) a toggle link rotatably supported by the toggle link pins, wherein the cross member on which the second end of each of the pair of toggle link pins is pivoted is hollow.

2. The jaw crusher according to claim 1, wherein:

the reaction force-receiving link mechanism comprises a pair of lock cylinders whose pistons respectively have a distal end that is rotatably coupled to the toggle link by way of a coupling shaft, the main supporter is provided to a side of the cross member adjacent to the swing jaw, and supporting portions that support cylinder bodies of the pair of the lock cylinders are provided to a side of the cross member opposite to the side to which the main supporter is provided.

3. The jaw crusher according to claim 2, wherein:

the reaction force-receiving link mechanism comprises a link plate having an end engaged to a rear portion of the swing jaw, and a biasing mechanism that biases the link plate in a predetermined direction is provided to an outer side of the toggle link.

4. The jaw crusher according to claim 3, wherein:

the reaction force-receiving link mechanism comprises a pair of arms that support the other end of the link plate and are rotatably supported by the pair of toggle link pins, coupling centers of the lock cylinders relative to the coupling shaft are displaced axially inward with respect to support centers of the arms relative to the toggle link pins, and the biasing mechanism is disposed in a space created by a displacement between the side wall plates and the toggle link.

5. The jaw crusher according to claim 1, wherein the cross member comprises a body that connects the side wall plates and the main supporter that extends from the body and supports the second ends of the pair of toggle link pins.

6. A self-propelled crushing machine comprising a jaw crusher, the jaw crusher comprising:

a crusher frame that comprises a pair of side wall plates, a rear wall plate and a cross member that connects the pair of the side wall plates;

a fixed jaw attached to the rear wall plate;

a swing jaw swingably hung between the side wall plates; and a reaction force-receiving link mechanism that comprises:

(i) a pair of toggle link pins respectively having a first end pivoted on each of the pair of side wall plates and a second end pivoted on a main supporter provided to the cross member, the pair of toggle link pins being coaxially disposed, and (ii) a toggle link rotatably supported by the toggle link pins, wherein the cross member on which the second end of the pair of toggle link pins is pivoted is hollow.

7. The self-propelled crushing machine according to claim 6, wherein the cross member comprises a body that connects the side wall plates and the main supporter that extends from the body and supports the second ends of the pair of toggle link pins.

8. A jaw crusher, comprising:

a crusher frame that comprises a pair of side wall plates, a rear wall plate and a cross member that connects the pair of side wall plates, the cross member having a main supporter and a tubular body;

a fixed jaw attached to the rear wall plate;

a swing jaw swingably hung between the side wall plates; and a reaction force-receiving link mechanism that comprises:

(i) a pair of toggle link pins respectively having a first end pivoted on each of the pair of side wall plates and a second end pivoted on the main supporter, the pair of toggle link pins being coaxially disposed, and (ii) a toggle link rotatably supported by the toggle link pins, wherein the tubular body is fitted to the side wall plates, and the main supporter extends from the tubular body and is formed in a box, and wherein the main supporter includes side surfaces pivoting the second end of the toggle link pins, an upper surface covering an area between upper ends of the side surfaces, a lower surface covering an area between lower ends of the side surfaces, and a curved surface connecting the upper surface and the lower surface continuously.

* * * * *